United States Patent [19]

Hugron

[11] Patent Number: 5,010,698

[45] Date of Patent: Apr. 30, 1991

[54] ANCHORING POST ASSEMBLY

[76] Inventor: Denis P. Hugron, 1855, Georges, St-Hubert, Quebec, Canada

[21] Appl. No.: 553,526

[22] Filed: Jul. 17, 1990

[51] Int. Cl.[5] ..... E02D 5/80

[52] U.S. Cl. ..... 52/160; 135/118

[58] Field of Search ..... 52/155, 160, 159, 161, 52/163; 135/118

[56] References Cited

U.S. PATENT DOCUMENTS

| | | | |
|---|---|---|---|
| 904,198 | 11/1908 | Haase | 52/160 |
| 958,127 | 5/1910 | Hovrud | 51/160 |
| 2,396,276 | 3/1946 | Lang | 52/161 |
| 2,431,609 | 11/1947 | Clapper | 52/161 |
| 2,966,243 | 12/1960 | Clapper | 52/161 |
| 3,526,069 | 9/1970 | Deike | 52/160 |
| 3,772,838 | 11/1973 | Virnig | 52/160 |
| 3,861,097 | 1/1975 | Patterson | 52/160 |

FOREIGN PATENT DOCUMENTS

| | | | |
|---|---|---|---|
| 24672 | 2/1906 | Austria | 52/160 |
| 306186 | 2/1929 | United Kingdom | 52/159 |

*Primary Examiner*—John E. Murtagh

*Attorney, Agent, or Firm*—Roland L. Morneau

[57] ABSTRACT

An anchoring post adapted to be inserted in the ground is made of a hollow tube having two laterally slanted channels inside the tube adjacent its bottom end. A bifurcated element having two prongs is adapted to be pushed downwardly in the tube, in the ground through the channels until the prongs project outwardly and laterally for retaining the tube in the ground.

4 Claims, 4 Drawing Sheets

8
86 20 30 78 82 30
82 78

76 74 78
10
76 74

70 68

72
8
82 86 30 20
9 9
74 78
10 10
70 70
68 80 80
72

82
78
84

94
13
92
90
13
36
38
28
30
68
68
80

90
62
60
56
30
92
30

100
98
88
38
36
30
88
78
82
78
87
88
86
30
78
78
30
84
102
102

ANCHORING POST ASSEMBLY

BACKGROUND OF THE INVENTION (1) Field of the Invention

The present application relates to an anchoring post adapted to be driven in the ground with prongs extending laterally from the lower end of the the post so as to prevent the latter from being pulled out the ground. The present post is particularly adapted to hold down tent-like structure such as temporary garage shelters.

(2) Brief Description of the Prior Art

A search made by the inventor has failed to disclose pertinent references.

Canadian patent No. 852,913, is directed to a guy wire ground anchor having a shaft surrounded by relatively large tilted plates referred to as helix.

An in-ground trailer post assembly is disclosed in Canadian patent No. 1,134,590, but such post is adapted to be set in concrete. A large hole needs to be dug in the ground for setting the concrete while in the present invention, only a small hole needs to be drilled.

SUMMARY OF THE INVENTION

An anchoring post, according to the invention, is made of a tubular member adapted to be inserted into the ground. The tubular member has at least one internal prong adapted to be pushed through a side opening at the lower end of the tubular member and to extend laterally in the ground to retain the post in the ground.

DESCRIPTION THE PREFERRED EMBODIMENTS

Figure 1:
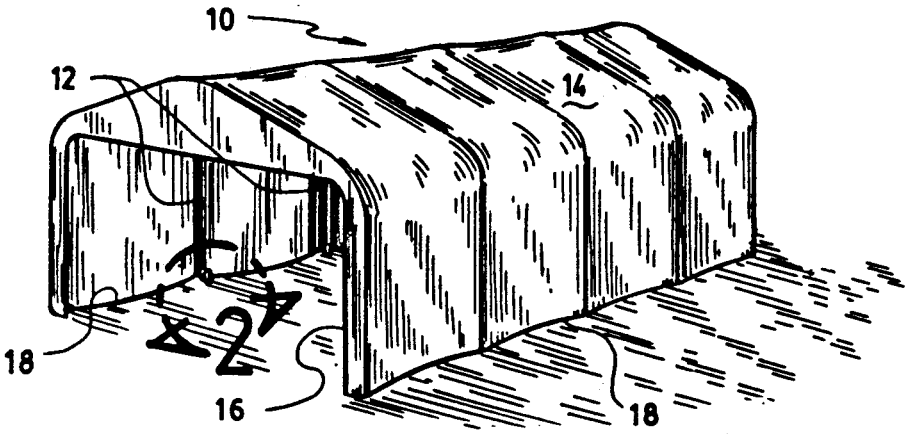
FIG. 1 shows a perspective view of a car shelter made of a plastic membrane.

FIG. 1 illustrates one example of the use of the anchoring device according to the present invention. The temporary garage 10 which is generally used during the winter for sheltering a car against snow is made of a metallic structure represented by a plurality of upstanding metallic rods covered with a plastic membrane 14. The shelter 10 is provided with an entrance 16 which is usually covered by a plastic door (not shown). When the wind blows through the entrance 16, the membrane 14 has a tendancy to be blown upwardly and is accordingly not stable. Various solutions have been proposed to fight the tendancy of the shelter to raise, one of which consists of bags of sand or water fixed to the lower edge 18 of the shelter 10.

The solution proposed by the present invention consists of anchoring posts fixed to the rods 12 or any structure connecting the rods 12.

Figure 2:
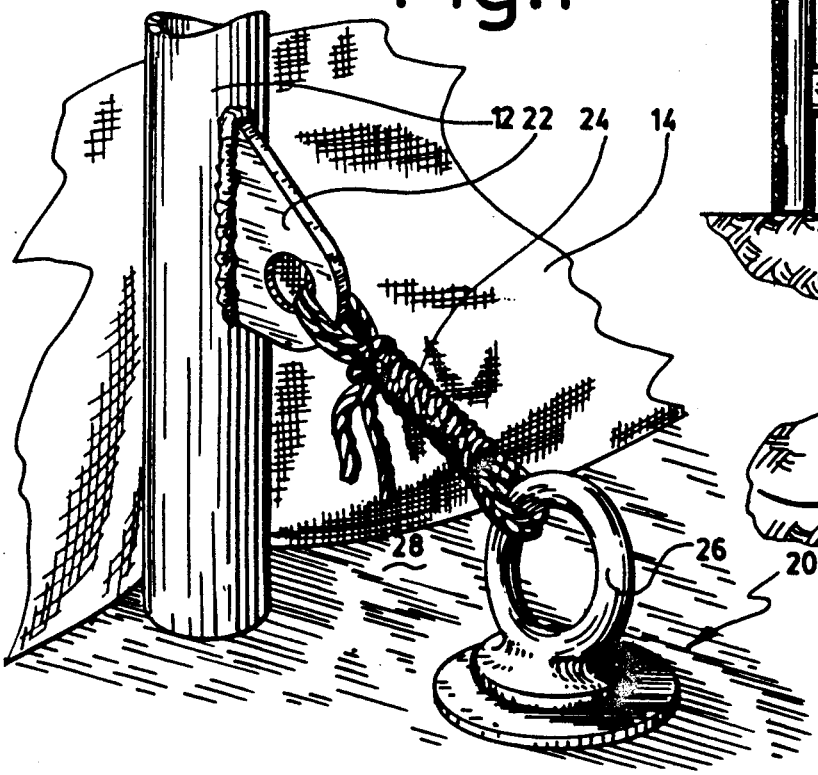
FIG. 2 is an enlarged view of the encircled portion 2 shown in FIG. 1.

FIG. 2 shows one arrangement for connecting a rod 12 to a anchoring post 20, according to the invention. A bracket 22 is welded to the rod 12 and is pulled downwardly by a cable 24 tied to an eye nut 26 at the top of the anchoring post 20.

Figure 3:
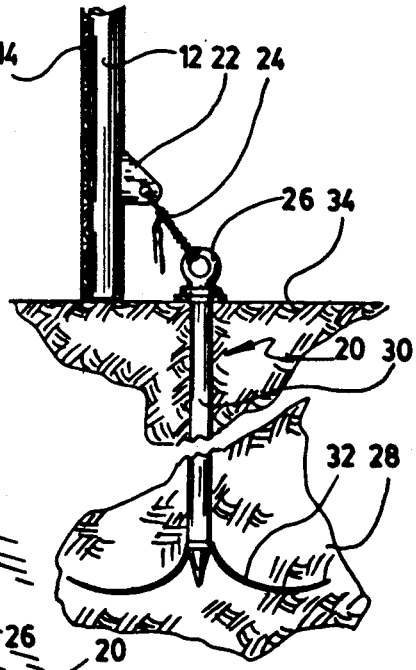
FIG. 3 is a side view of an upstanding metallic rod of the shelter supported by an anchoring post in the ground according to the invention.
Figure 4:
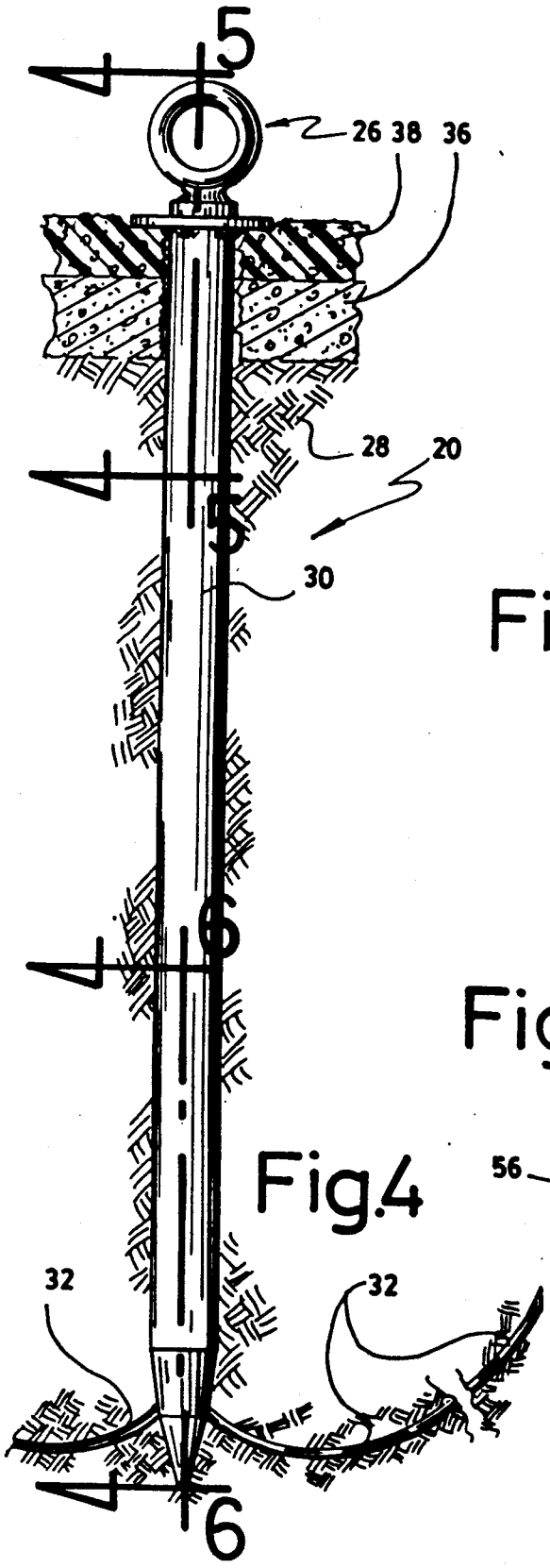
FIG. 4 shows a side view of the anchoring post according to the invention with the prongs extending into the ground.

FIG. 3 shows the general installation of the post 20 through the ground 28. It is essentially made of a tubular member 30 projecting into the ground 28 and having a pair of prongs 32 extendig laterally from the lower end of the tubular member 30 so as to retain the tube in the ground at a level below the surface 34 of the ground. Once the post 20 is installed, with its eye nut 26 at the top, the latter is tied to the bracket 22 to maintain the rod 22 firmly in contact with the ground 28. The tubular member 30 projects downwardly into the ground 28 through a layer of ciment 36 or a layer of asphalt 38 or both as shown in FIG. 4. Detail of the installation operation of the post 20 will be explained later in detail.

Figure 5:
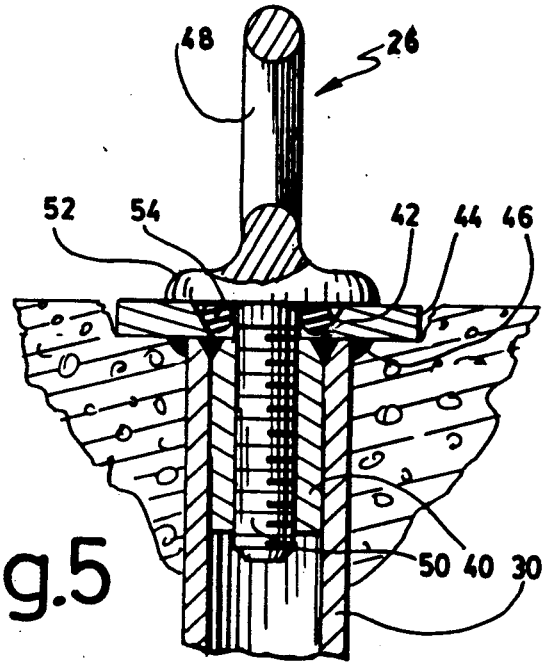
FIGS. 5 and 5*a* are two cross-sectional views of the upper portion of an anchoring post according to the invention.

The eye nut 26, as shown in FIG. 5, is mounted on the tubular member 30 through an internally threaded sleeve 40 which is tightly crimped inside the tubular member 30 and additionally welded at 42 adjacent the top of both sleeve 40 and tubular member 30. A flat ring 44 is welded at 46 to the tubular member 30. The ring 44 has a diameter greater than the diameter of the tubular member 30 and is intended to prevent the tubular member 30 from being driven excessively into the ground. The eye nut 26 which is made of an eye ring 48 and a threaded bolt 50 has a shoulder 52 which rests on the surface of the flat ring 44 and which closes the aperture in the center of the flat ring 44. In order to prevent any water from leaking inside the tube 30 from below the shoulder 52, a O-ring 54, generally made of synthetic rubber is positioned around the upper part of the threaded portion 50 and is surrounded by the central aperture in the flat ring 44.

Figure 5A:
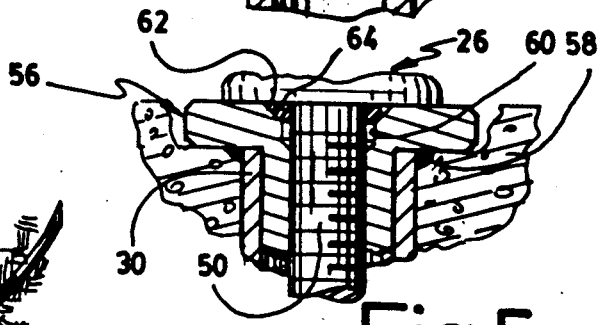
Figures 6, 8, 9, 10, 11:
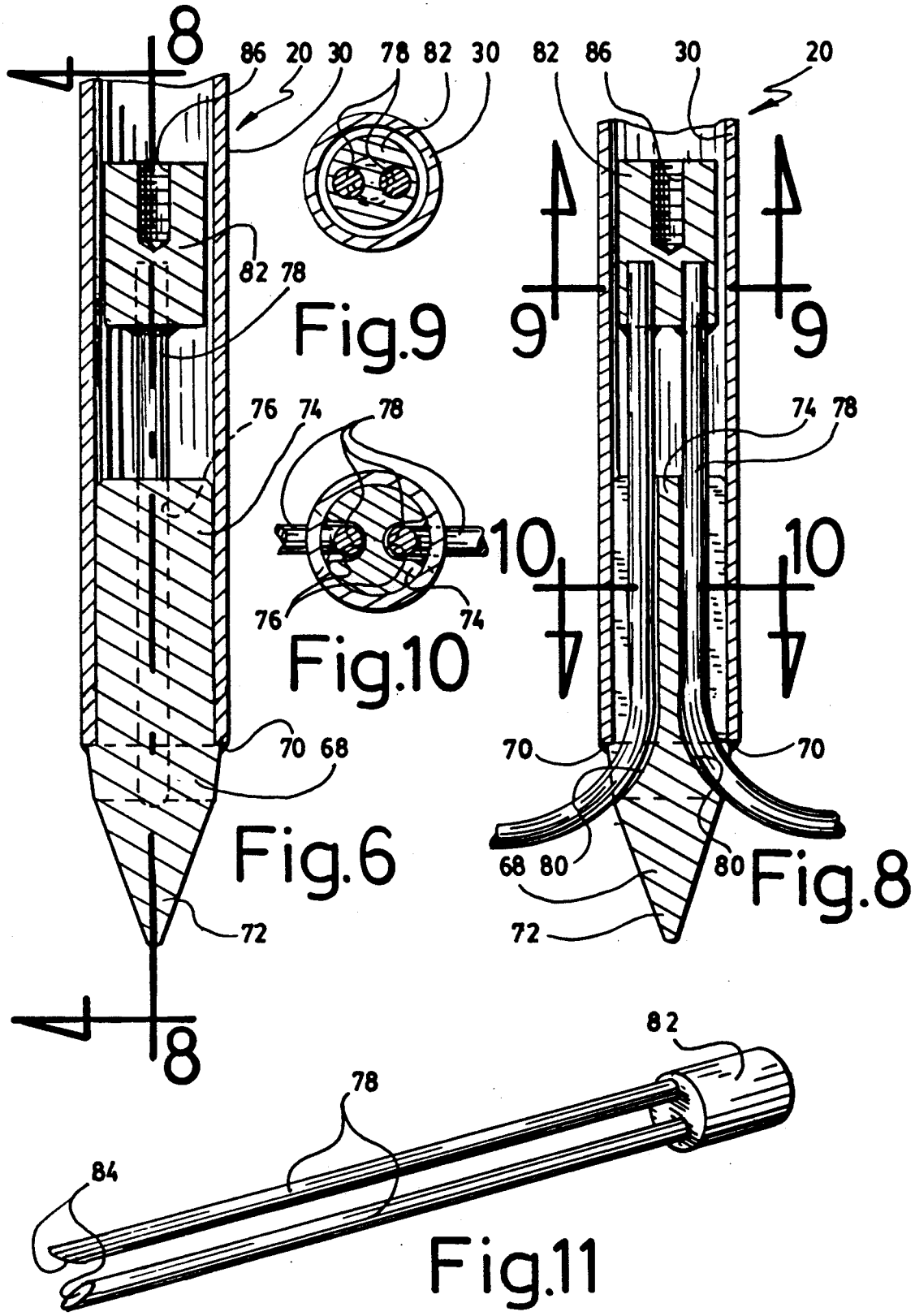
FIG. 6 is a cross-sectional view along line 6—6 of FIG. 4.
FIG. 8 is a cross-sectional view along line 8—8 of FIG. 6.
FIGS. 9 and 10 are cross-sectional views along line 9—9 and 10—10 respectively of FIG. 8.
FIG. 11 is a perspective view of the prongs secured to a neck portion.

FIG. 5*a* illustrates an alternative embodiment to the one shown in FIG. 5 in which a threaded bushing 56 is inserted in the tubular member 30 to which it is crimped and welded at 58. The upper horizontal part of the threaded bushing 56 is made to have a diameter sufficiently large so as to maintain the upper part of the tubular member 30 preventing it from any undesirable digging in the ground. The threaded bushing 56 is provided with a counterbore 60 to accommodate the cylindrical part at the upper end of the threaded bolt 50 and with a chamfer 62 to accommodate a O-ring 64 for providing a seal corresponding to the one mentioned for the O-ring 54.

Figure 7:
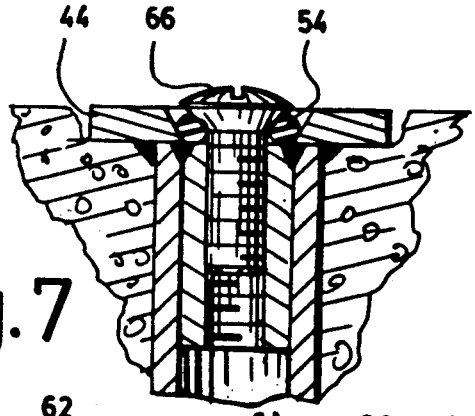
FIG. 7 is a cross-sectional view of the top portion of an anchoring post with a flat-head bolt mounted in the post.

FIGS. 5 and 5*a* illustrate the installation of the eye nut 26 on the tubular member 30 for the period while the tubular member 30 is used as an anchoring post, that is, when it is tied with cables such as 24 to an adjacent structure. During a certain period of the year, the eye bolt 26 may not be needed. This applies to a temporary garage shelter such as 10 when the latter is removed during the summer. Such eye bolt may be a hinderance to the free circulation of the vehicle during the summer and may even be a cause of accidents. When the anchoring post is not used, the eye nut 26 is removed and replaced by a regular flat-head bolt 66. The embodiment shown in FIG. 7 corresponds to the one shown in FIG. 5. The O-ring 54 is made to be squeezed in order to prevent any penetration of water in the tubular member 30.

Figures 8A, 12, 13, 14:
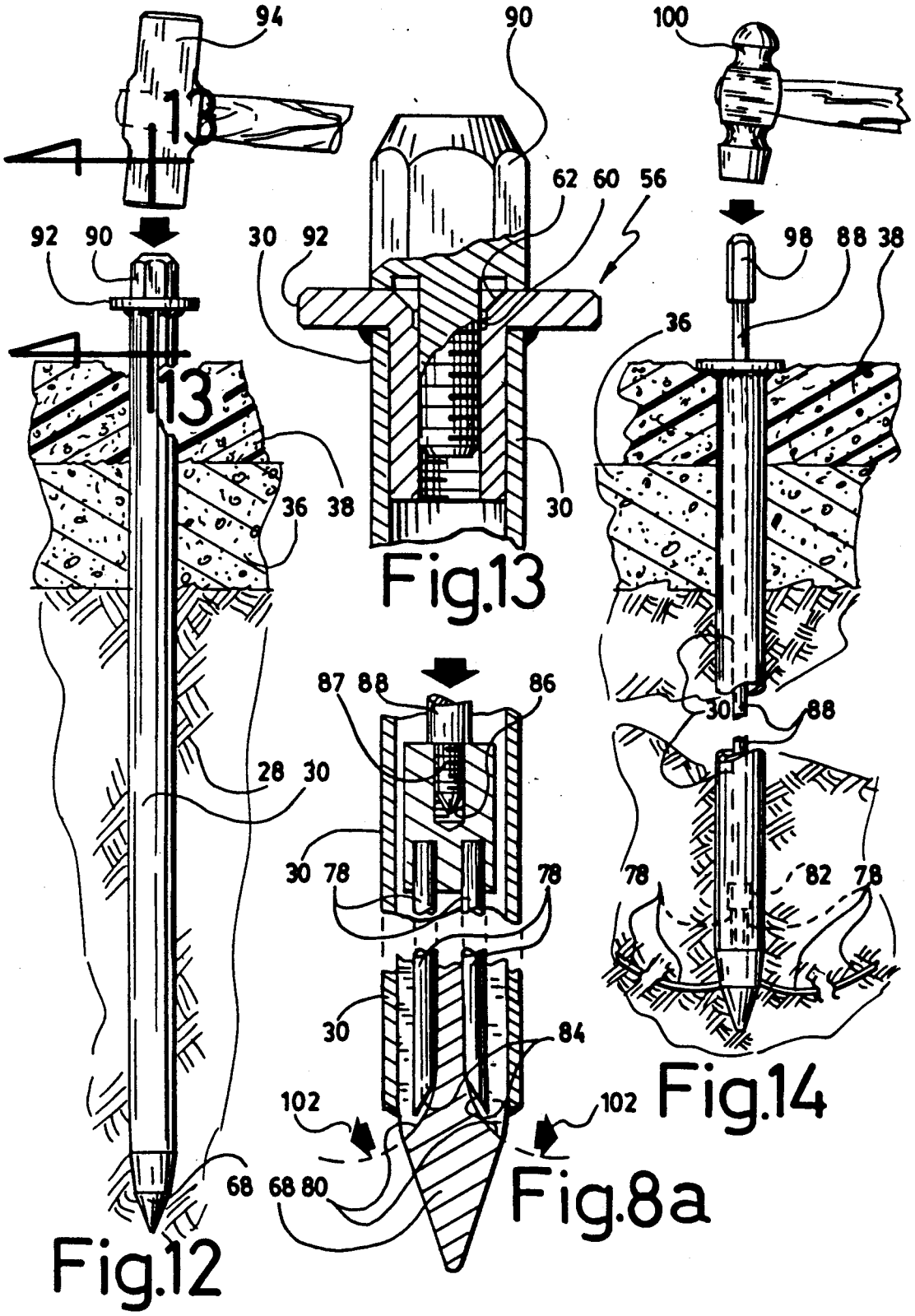
FIG. 8*a* is a cross-sectional view along line 8—8 of FIG. 6 before the prongs are laterally projected.
FIG. 12 is a side view of the anchoring post while being hammered into the ground.
FIG. 13 is a cross-sectional view along line 13—13 of FIG. 12.
FIG. 14 is a side view of the anchoring post during the operation of the lateral projection of the prongs from the post

FIGS. 6, 8, 9 and 10 particularly illustrate the lower end of the anchoring post which is made of the tubular member 30 and a pointed tip 68 which is welded at the lower periphery of the tube 30. The pointed tip 68, generally made of cast iron has a conical lower end 72 adapted to facilitate the penetration of the post in the ground and an upper portion 74 which is generally cylindrical and which has two diametrically opposed vertical channels 76 therethrough or adjacent the periphery of the upper portion 74. The portion 74 tightly fits into the lower end of the tube 30 and is preferably crimped to it in addition to be welded at 70. The two channels 76 are adapted to receive two prongs 78 for slidingly moving therethrough. The two prongs 78 are two elongated rods made out of stainless steel. Stainless steel is preferred because the prongs, while in the ground, such as illustrated in previous FIGS. 3 and 4, will not rust. Furthermore, the stainless steel selected is flexible so that they can follow the curved part 80 of the channels 76 and maintain substantially that curve into the ground, as shown in FIGS. 3 and 4. The two prongs 78 are connected at their upper end by a neck portion 82 adapted to freely slide inside the tube 30. The two prongs 78 are disposed in a parallel relationship with each other and are welded to the neck portion 82. The free lower end of both prongs 78 are tapered and preferably flatened on their inner surface 84. The two flatened surfaces 84 are facing each other in order to face the curved portion 80 of the pointed tip 68 particularly as shown in FIG. 8*a*.

The neck portion 82 is internally threaded along its central axis at 86. The threaded portion 86 extends towards the upper part of the neck portion 32 to receive the lower threaded end 87 of an elongated bar 88 as shown in FIGS. 8*a* and 14.

The anchoring post 20, once installed, substantially provides an appearance as shown in FIG. 4 with its eye bolt 26 available to be tied to a surrounding structure and with the two prongs 82 extending laterally into the ground at the bottom of the post 20. The installation of the post is explained with the illustrations of FIGS. 12, 13 and 14. When the ground 28 is covered with a crust such as a layer of ciment 36 or asphalt 38 or both, as illustrated in FIG. 12, the crust is drilled with a common drill to a diameter suitable to allow a fitted entrance to the diameter of the tubular member 30. The latter is then introduced into the crust 36 and 38 with the prongs 78 and neck portion 82 inside the tubular member 80. In order to hammer the tubular member 30 into the ground 28, without damaging the upper surface of the threaded bushing 56, as shown in FIGS. 5*a* and 13 or the ring 44 shown in FIGS. 5 and 7, a bolt 90 is temporarily mounted in the threaded bushing 56, as shown in FIGS. 12 and 13. The head of the bolt 90 can then be hammered such as shown in FIG. 12 until the ring 92 of the threaded bushing 56 is flat on the upper surface of the crust 38. This operation is usually relatively easy with the pointed tip 68 facilitating the entrance of the post in the ground 28. A sledge hammer 94 may be used if some resistance occurs in the ground without damaging the tubular member which is compressed in a longitudinal direction. When this operation is completed, the bolt 90 is removed from the threaded bushing 56 and a threaded bar 88 is introduced into the tubular member 30 through the central aperture of the threaded bushing 56. The lower threaded end 96 of the bar 88 is adapted to fit in the internally threaded portion 86 of the neck portion 82. The head 98 of the bar 88 is then hammered usually with an ordinary hammer 100 to initiate the lateral projection of the lower end of the prongs 78 in the direction of the arrows 102 (FIG. 8*a*). This initial curving movement of the prongs 78 is essentially produced by the curve 80 in the pointed tip 68 while an upper section 104 of the prong 78 will abut against the inner lower periphery of the tubular member 30. The lower tapered end of the prong or the corresponding flatened surface 84 helps to initiate the movement of the prongs. The head 98 is further hammered until the prongs 78 have fully extended outwardly of the tubular member 30. For this reason, the length of the bar 88 is selected so as to be able to push the neck portion 82 until it reaches substantially the upper portion 74 of the pointed tip 68. At that stage, the bar 88 is threadedly unfastened from the neck portion 82 to free the aperture of the threaded bushing 56. The eye nut 26 is then threadedly mounted at the top of tubular member inside the threaded bushing 56. The post is then ready to be tied to an adjoining structure which needs to be held against the ground.

Although the bar 88 needs to be hammered to initiate the bending of the prongs along the curves 80, the bar 88 can generally be lowered subsequently with only the strength of the arms.

As stated above, the threaded bushing 56 is provided with a chamfer 62 around the threaded opening, this chamfer is useful if the top of the threaded bushing 56 is hammered unintentionally which would restrict the opening for the introduction of the threaded bolt 50 of the eye nut 26.

The advantage of the present invention is that it requires only a common drill as an additional tool to pierce the crust 36 and 38 while the remaining elements such as the bolt 90 and the bar 88 are supplied with a set of anchoring posts, such as illustrated in FIG. 4.

Tests have been carried out with anchoring posts having a tubular member about 20 to 24 inches long. With prongs having a length of about 12 inches, the anchoring post could stand a traction force of about 300 pounds.

In order to provide a good lateral extension of the prongs into the ground, curves 80 having a tangent of about 45° is preferred. However, the ground is frequently made of a mixture of earth and small rocks. The prongs, nevertheless, extend laterally although they form various patterns.

I claim:

1. An anchoring post adapted to be driven into the ground, said post comprising:

a hollow uniform cylindrical member;

a pointed tip rigidly secured to the lower end of said cylindrical member, said tip having an upper tubular portion fittingly inserted into said cylindrical member and a conical lower portion extending below said cylindrical member, said tubular portion having a pair of vertical recessed channels grooved on its periphery and diametrically disposed relative to each other, said channels extending downwardly and partly into the conical portion to provide a pair of diametrically disposed openings below the cylindrical member, said channels having a slanted lower face directed outwardly in opposite directions, a tubular neck portion slidingly fitting into said cylidrical member above said pointed tip, a pair of elongated prongs rigidly secured to said tubular neck portion at the lower end thereof, said prongs being diametrically disposed relative to said tubular neck portion, and each prong adapted to fittingly slide into a corresponding channel of said channels, said neck portion being provided with a threaded bore adapted to threadedly receive a threaded bar for downwardly pushing said prongs through said openings until said neck portion abuts against said pointed tip, said prongs adapted to laterally extend outwardly relative to said cylindrical member, a sleeve inwardly secured at the upper end of said cylindrical member, said sleeve having an internally threaded hole, a flat ring secured at the upper end of said cylindrical member and of said sleeve for providing a wide striking surface for driving said cylindrical member into the ground and a tieing nut threadedly mounted in said sleeve for tightly closing said threaded hole, whereby said cylindrical member is driven into the ground by pressure applied on said flat ring, and said prongs are driven through said openings into the ground laterally in opposite directions relative to the cylindrical member by said bar pushing on said neck portion through said sleeve, said threaded hole being subsequently closed by said tieing nut.

2. An anchoring post as recited in claim 1, wherein said pointed tip comprises a peripheral shoulder adjacent the intersection of the lower and upper portion for abutting the lower end of the cylindrical member, said lower end to said pointed tip around said intersection being welded to said cylindrical member.

3. An anchoring post as recited in claim 2, wherein said neck portion abuts against said pointed tip when the prongs are fully projected out of said openings.

4. An anchoring post as recited in claim 2, wherein the cross-section of the prongs substantially corresponds to the cross-section of the channel for preventing insertion of foreign matters into the channels when the post is driven into the ground.

* * * * *